US006915661B2

(12) United States Patent
Le Bot

(10) Patent No.: US 6,915,661 B2
(45) Date of Patent: Jul. 12, 2005

(54) INTEGRATED AIR SEPARATION PROCESS AND APPARATUS

(75) Inventor: Patrick Le Bot, Vincennes (FR)

(73) Assignee: L'Air Liquide - Societe Anonyme a'Directoire et Conseil de Surveillance pour l'Etude et l'Exploitation des Procedes George Claude, Paris (FR)

( * ) Notice: Subject to any disclaimer, the term of this patent is extended or adjusted under 35 U.S.C. 154(b) by 0 days.

(21) Appl. No.: 10/656,473

(22) Filed: Sep. 5, 2003

(65) Prior Publication Data

US 2004/0089021 A1 May 13, 2004

Related U.S. Application Data

(60) Provisional application No. 60/425,860, filed on Nov. 13, 2002.

(51) Int. Cl.[7] ..... F25J 1/00; F02B 43/00; F02G 3/00

(52) U.S. Cl. ..... 62/611; 62/612; 60/39.12; 60/785

(58) Field of Search ..... 62/611, 612, 614, 62/648; 60/39.12, 39.182, 726, 785, 780

(56) References Cited

U.S. PATENT DOCUMENTS 3,735,600 A * 5/1973 Dowdell et al. ..... 62/619
4,184,322 A * 1/1980 Paull et al. ..... 60/780
5,139,548 A * 8/1992 Liu et al. ..... 62/611
5,345,756 A * 9/1994 Jahnke et al. ..... 60/781
5,394,686 A * 3/1995 Child et al. ..... 60/780
5,689,141 A * 11/1997 Kikkawa et al. ..... 290/52
6,141,950 A * 11/2000 Smith et al. ..... 60/783
6,324,867 B1 * 12/2001 Fanning et al. ..... 62/613
6,508,053 B1 * 1/2003 Ha et al. ..... 60/39.12
6,596,780 B2 * 7/2003 Jahnke et al. ..... 518/700

* cited by examiner

*Primary Examiner*—William C. Doerrler
(74) *Attorney, Agent, or Firm*—Linda K. Russell

(57) ABSTRACT

In a process for separating air in a system comprising a gas turbine, including a compressor (1), a combustor (5) and an expander (17), said expander being coupled to the compressor, a natural gas conversion unit (23) and an air separation unit (20), air is compressed in the compressor, a first part (3) of the air is sent to the combustor and a second part (7) of the air is sent to the air separation unit, oxygen enriched gas (21) is sent from the air separation unit to the natural gas conversion unit, compressed nitrogen enriched gas (16) is sent upstream of the expander, a first stream (33) of natural gas is sent to the natural gas conversion unit, a second stream of natural gas (35) is sent to a natural gas liquefaction unit and work produced by the expander is used to operate a cycle compressor of a refrigeration cycle of the natural gas liquefaction unit.

31 Claims, 2 Drawing Sheets

INTEGRATED AIR SEPARATION PROCESS AND APPARATUS

CROSS-REFERENCE TO RELATED APPLICATIONS

This application claims the benefit under 35 U.S.C. § 119 (e) to provisional Application No. 60/425,860, filed Nov. 13, 2002, the entire contents of which are incorporated herein by reference.

FIELD OF THE INVENTION

The present invention relates to an integrated air separation process and apparatus. In particular, it is related to an air separation process integrated with a gas turbine process and a natural gas liquefaction process.

BACKGROUND OF THE INVENTION

It is known from U.S. Pat. No. 3,731,495 to integrate an air separation unit (ASU) with a gas turbine by removing compressed air from the gas turbine compressor, sending it to the ASU and sending a nitrogen enriched gas from the ASU upstream of the expander of the gas turbine. In this case, the expander of the gas turbine is coupled to the gas turbine compressor.

It is known from U.S. Pat. No. 4,566,885 and U.S. Pat. No. 5,139,548 to couple the compressors of two gas turbines with the cycle compressors of a refrigeration cycle, using a multicomponent refrigerant (MCR), of a natural gas liquefaction process.

At certain sites, it may be desired to transform a first stream of natural gas into liquefied natural gas and a second stream of natural gas at least one product of the conversion of the natural gas, such as methanol, DME or the product of a Fischer Tropsch reaction. The conversion reaction frequently requires the supply of large amounts of gaseous oxygen. Heat generated by the reaction is commonly used to raise steam which is then expanded in a steam turbine to generate electricity.

An object of the invention is to reduce the costs of a production complex which simultaneously produces from the same natural gas source both liquefied natural gas and a product of the conversion of the natural gas, such as methanol, dimethyl ethers or a Fischer Tropsch product, by integrating an air separation unit, a gas turbine, a natural gas conversion unit and a natural gas liquefaction unit.

Typically in the prior art, the power requirements are provided by a steam turbine powering the MAC compressor of the ASU as shown in U.S. Pat. Nos. 3,868,817, 4,099,383 and 4,184,322 and two gas turbines powering the multicomponent refrigerant cycle and propane cycle of the natural gas liquefier as mentioned above.

The integrated process of the invention uses only a single gas turbine.

SUMMARY OF THE INVENTION

According to one aspect of the invention, there is provided a process for separating air in a system comprising a gas turbine, including a compressor, a combustor and an expander, said expander being coupled to the compressor, a natural gas conversion unit, a natural gas liquefaction unit and an air separation unit comprising the steps of:

a) compressing air in the compressor, sending a first part of the air to the combustor and a second part of the air to the air separation unit;

b) separating at least the second part of the air in the air separation unit to form at least an oxygen enriched gas and an nitrogen enriched gas;

c) sending a first stream of natural gas from a source of natural gas to the natural gas conversion unit and at least part of the oxygen enriched gas to the natural gas conversion unit;

d) compressing at least part of the nitrogen enriched gas and sending at least part of the compressed nitrogen enriched gas upstream of the expander; and, e) feeding a second stream of natural gas from the source of natural gas to the natural gas liquefaction unit, wherein work produced by the expander is used to operate a cycle compressor of a refrigeration cycle of the natural gas liquefaction unit.

The terms 'oxygen enriched', 'nitrogen enriched' and 'argon enriched' mean enriched with respect to air.

According to further optional aspects of the invention:

the second part of the air is compressed to a pressure P in the compressor and is sent to the air separation unit to be separated at substantially pressure P.

the expander is coupled to cycle compressor of a refrigeration cycle.

the natural gas conversion unit generates steam which is expanded in a steam turbine.

the air separation unit comprises at least two columns, at least one of which functions at a pressure of at least 8 bar abs.

The process may also include the steps of:

sending a fuel gas from the natural gas conversion unit to the combustor, deriving steam from the natural gas conversion process, expanding the steam in a turbine and using the energy produced to drive at least one compressor from the group comprising a dedicated main air compressor of the air separation unit, a booster of the air separation unit, a compressor of the air separation unit compressing nitrogen enriched gas, a compressor of the air separation unit compressing oxygen enriched gas, a compressor of a propane cycle of the natural gas liquefaction unit, and/or using electricity generated by the steam turbine to power a respective motor for at least one compressor from the group comprising a dedicated main air compressor of the air separation unit, a booster of the air separation unit, a compressor of the air separation unit compressing nitrogen enriched gas, a compressor of the air separation unit compressing oxygen enriched gas and a compressor of a propane cycle of the natural gas liquefaction unit.

The cycle compressor is a multi-component refrigeration fluid compressor or a propane cycle compressor.

According to a further aspect of the invention, there is provided an integrated apparatus comprising an air separation unit, a gas turbine having an air compressor, a combustor and an expander, a natural gas conversion unit and a natural gas liquefaction unit having a) conduits for sending air from the air compressor to the combustor and to the air separation unit;

b) a conduit for sending a nitrogen enriched gas from the air separation unit to a point upstream the expander;

c) a conduit for sending an oxygen enriched gas from the air separation unit to the natural gas conversion unit;

d) a conduit for sending a first stream of natural gas from a natural gas source to the natural gas conversion unit;

e) a conduit for sending a second stream of natural gas from the natural gas source to the natural gas liquefaction unit; and, f) means for transferring work from the expander to the air compressor and to a compressor of a refrigeration cycle of the natural gas liquefaction unit.

Additionally, the expander may be coupled to the air compressor. Also, The apparatus may comprise a conduit for sending natural gas to a natural gas conversion unit and a conduit for sending an oxygen enriched gas from the air separation unit to the conversion unit. Preferably the expander is coupled to the compressor of the refrigeration cycle.

DETAILED DESCRIPTION OF THE INVENTION

Figure 1:
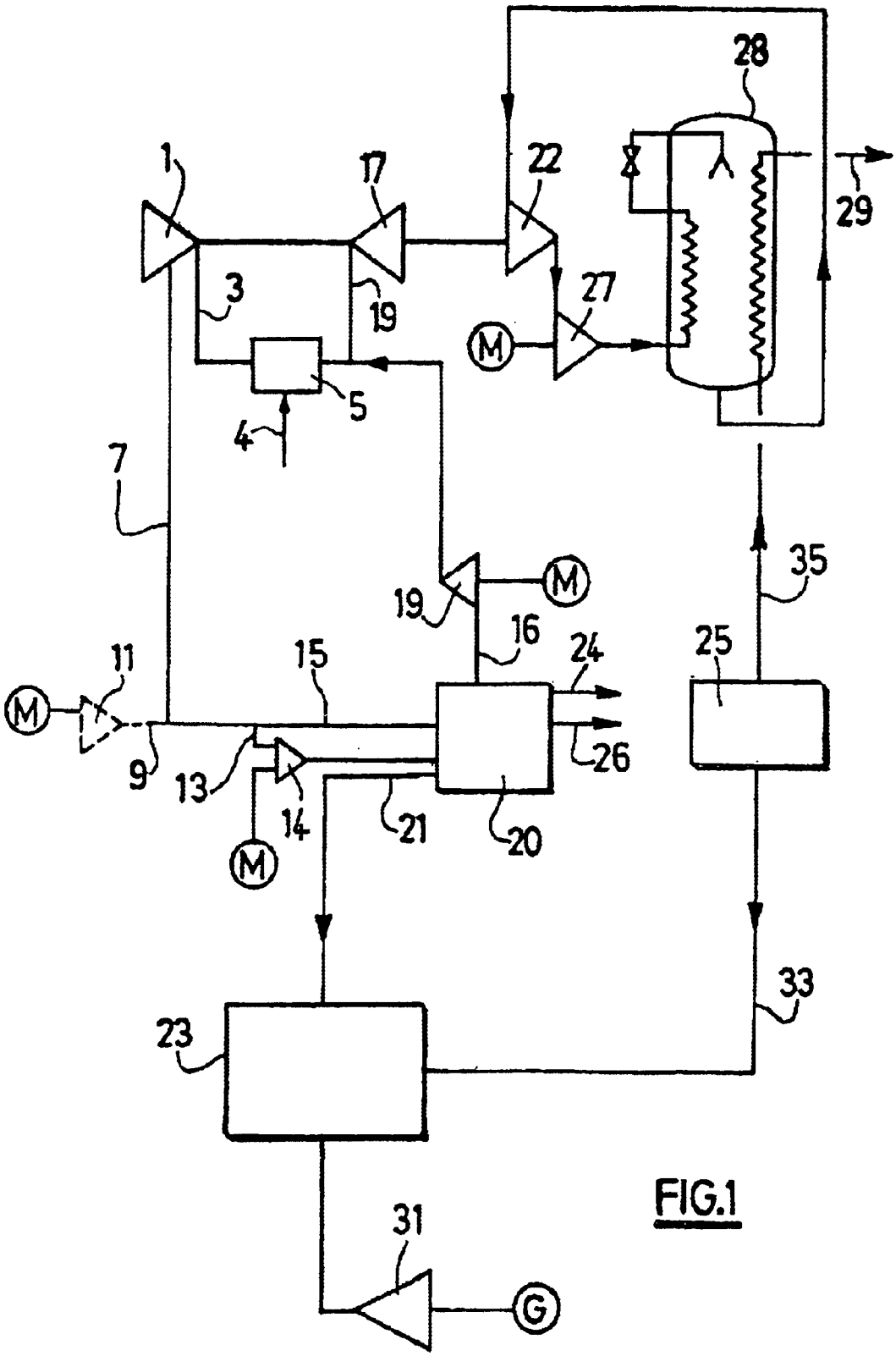
FIG. 1 shows an air separation unit (ASU) inte grated with a gas turbine (GT) a natural gas conversion unit and a natural gas liquefaction unit.

The compressor 1 of a gas turbine produces a first part of compressed air 3 which is sent to a combustor 5. The combustor is also fed by fuel 4 which may be (or may include) natural gas from natural gas source 25. The rest of the compressed air 7 is mixed with compressed air 9 from a dedicated main air compressor (MAC) 11 and thereafter cooled and purified (not shown). The dedicated main air compressor is not an essential part of the apparatus. Between 10 and 30% of the air 13 may be further compressed in a booster air compressor (BAC) 14 to a pressure required to vaporize the liquid oxygen, for example. The booster is also not essential to the apparatus since certain air separation processes use a single high air pressure. The further compressed air 13 is cooled in the main heat exchange line, liquefied and sent to the columns of the ASU 20. The mixture 15 of part of air streams 7 and 9 is sent to the column of the ASU 20 operating at the highest (or higher) pressure, which is above 8 bar abs. and frequently above 12 bar abs following cooling in the main heat exchange line.

The ASU may comprise a double or triple column system as described for example in patents EP-A-0504029 and EP-A-538857.

From a column of the ASU 20 operating at a lower pressure is withdrawn a nitrogen enriched gaseous stream 16. The stream is warmed in the main heat exchange line and then compressed in nitrogen compressor 19 and sent to the gas turbine to a point upstream of the expander 17. In the example the nitrogen is sent to a point downstream the combustion chamber but it may alternatively be sent to the combustion chamber.

An oxygen enriched gas stream 21 containing at least 99% mol. oxygen is removed from a column of the ASU as a liquid, pressurized to between 25 and 50 bar abs., vaporized in the main heat exchange line and sent to a natural gas conversion unit 23, such as a Fischer Tropsch unit, wherein a first stream of natural gas 33 from a natural gas source 25 is converted to other products.

The natural gas source may be a gas field connected by pipeline to the mainland or to an offshore treatment plant or a methane tanker.

The ASU 20 may also produce liquid final products 24 or argon enriched products 26.

The expander 17 is fed by combustion gases 19 from the combustor 5 and is coupled to the compressor 1. The MAC and BAC compressors 11, 14 are each coupled to a respective motor as is the nitrogen compressor 19. To provide electricity for at least one of the motors without requiring import of electricity from an external network, steam from the unit 23 may be expanded in a steam turbine 31 which is coupled to a generator.

The expander 17 is also coupled to a compressor 22 of a multicomponent refrigerant cycle used to liquefy a second natural gas stream 35 from natural gas source 25. Another compressor of the cycle 27 is driven by an electric motor, which is preferably fed with electricity produced by the stream turbine 31. The natural gas is cooled in vessel 28 by indirect and direct contact with the compressed multicomponent refrigerant compressed in compressors 22,27 and is thereby liquefied to form liquefied natural gas 29.

In the case of FIG. 1, the natural gas liquefaction plant is reduced to its simplest expression. In fact, such liquefaction plants are generally more complex involving a closed propane cycle.

Figure 2:
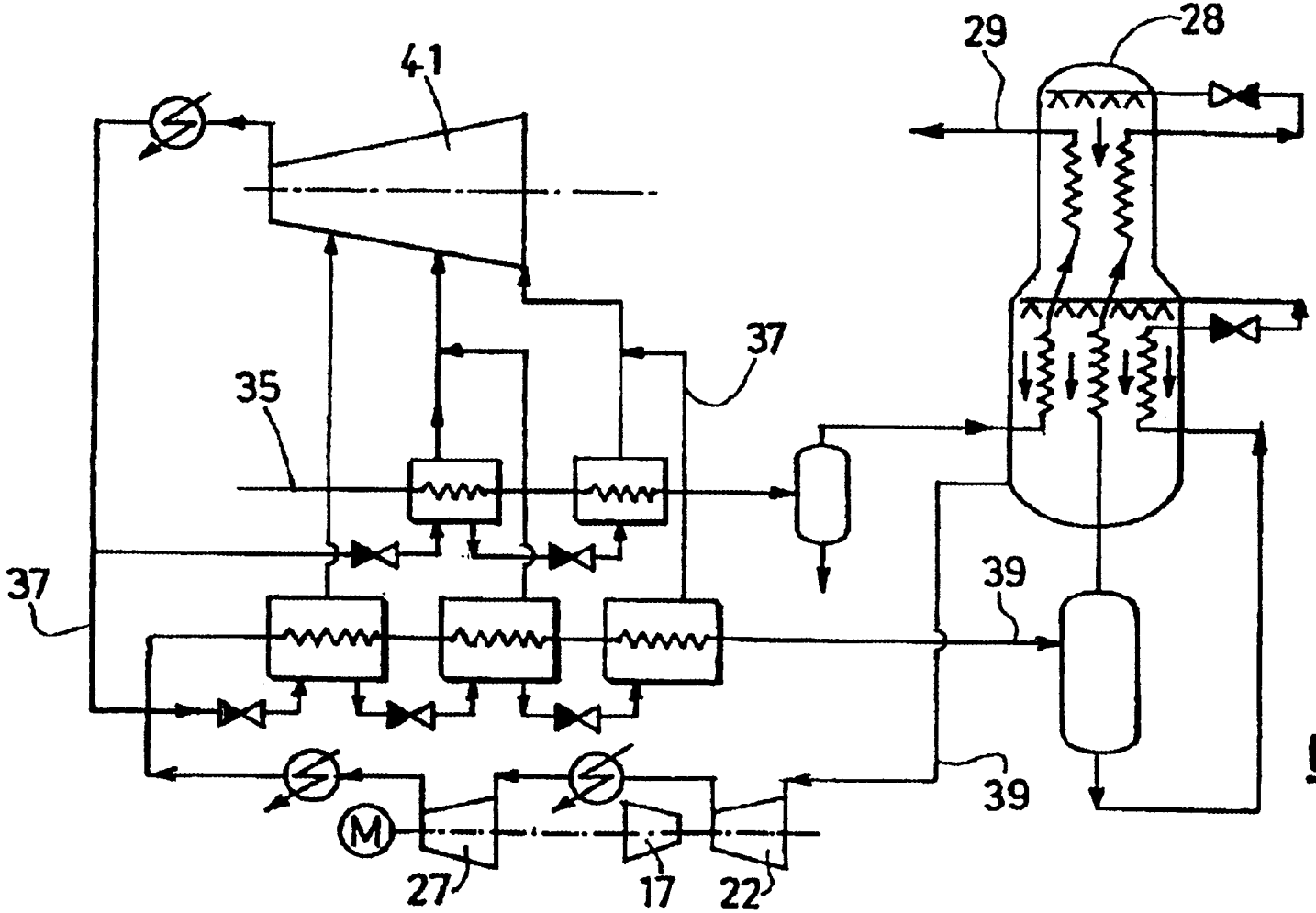
FIG. 2 shows a natural gass liquefaction unit modified to operate in an integrated process according to the invention.

FIG. 2 shows a natural gas liquefaction unit modified to operate in an integrated process according to the invention.

The second natural gas stream 35 is cooled using a closed propane cycle 37 and sent to the liquefier 28 to produced liquefied natural gas 29. A multicomponent refrigeration cycle 39 is used to liquefy the natural gas. One of the compressors 22 of the cycle is coupled to the gas turbine expander 17 whilst the other 27 has a motor fed by electricity generated by steam turbine 31. The compressor 41 of the propane cycle also has a motor fed by electricity generated by steam turbine 31.

It will be appreciated that in order to avoid importing electricity to what may be a remote site, it is preferable that the gas turbine expander be coupled to a compressor the natural gas liquefaction plant, such as an MCR compressor 22,27 or a propane compressor 41 where there is a propane cycle. Since air from the gas turbine compressor is sent to the ASU, the remaining compressors should be powered using electricity generated by the steam turbine.

What is claimed is:

1. A process for separating air in a system comprising a gas turbine, including a compressor, a combustor and an expander, said expander being coupled to the compressor, a natural gas conversion unit, a natural gas liquefaction unit and an air separation unit comprising the steps of:

a) compressing air in a compressor, sending a first part of the air to a combustor and a second part of the air to an air separation unit;

b) separating at least the second part of the air in the air separation unit to form at least an oxygen enriched gas and an nitrogen enriched gas;

c) sending a first stream of natural gas from a source of natural gas to the natural gas conversion unit and at least part of the oxygen enriched gas to the natural gas conversion unit;

d) compressing at least part of the nitrogen enriched gas and sending at least part of the compressed nitrogen enriched gas upstream of the expander; and, e) feeding a second stream of natural gas from the source of natural gas to the natural gas liquefaction unit, wherein the work produced by the expander is used to operate a cycle compressor of a refrigeration cycle of the natural gas liquefaction unit.

2. The process of claim 1 wherein the second part of the air is compressed to a pressure P in the compressor and is sent to the air separation unit to be separated at substantially pressure P.

3. The process of claim 1 wherein the expander is coupled to cycle compressor of the refrigeration cycle.

4. The process of claim 3 wherein the natural gas conversion unit generates steam which is expanded in a steam turbine.

5. The process of claim 1 wherein the air separation unit comprises at least two columns and, at least one of which functions at a pressure of at least 8 bar abs.

6. The process of claim 1 wherein a fuel gas from the natural gas conversion unit is sent to the combustor.

7. The process of claim 1 comprising deriving steam from the natural gas conversion process, expanding the steam in a turbine and using the energy produced to drive at least one compressor from the group comprising a dedicated main air compressor of the air separation unit, a booster of the air separation unit, a compressor of the air separation unit compressing nitrogen enriched gas, a compressor of the air separation unit compressing oxygen enriched gas, a compressor of a propane cycle of the natural gas liquefaction unit.

8. The process of claim 7 wherein electricity generated by the steam turbine is used to power a respective motor for at least one compressor from the group comprising a dedicated main air compressor of the air separation unit, a booster of the air separation unit, a compressor of the air separation unit compressing nitrogen enriched gas, a compressor of the air separation unit compressing oxygen enriched gas and a compressor of a propane cycle of the natural gas liquefaction unit.

9. The process of claim 1 where the cycle compressor is a multicomponent refrigeration fluid compressor.

10. The process of claim 1 where the cycle compressor is a propane cycle compressor.

11. An Integrated apparatus comprising an air separation unit, a gas turbine having an air compressor, a combustor and an expander, a natural gas conversion unit and a natural gas liquefaction unit having conduits for sending air from the air compressor to the combustor and to the air separation unit;

a) a conduit for sending a nitrogen enriched gas from the air separation unit to a point upstream the expander;

b) a conduit for sending an oxygen enriched gas from the air separation unit to the natural gas conversion unit;

c) a conduit for sending a first stream of natural gas from a natural gas source to the natural gas conversion unit;

d) a conduit for sending a second stream of natural gas from the natural gas source to the natural gas liquefaction unit; and e) means for transferring work from the expander to the air compressor and to a compressor of a refrigeration cycle of the natural gas liquefaction unit.

12. The apparatus of claim 11 wherein the expander is coupled to the air compressor.

13. The apparatus of claim 11 comprising a conduit for sending natural gas to the natural gas conversion unit and a conduit for sending an oxygen enriched gas from the air separation unit to the conversion unit.

14. The apparatus of claim 11 wherein the expander is coupled to the compressor of the refrigeration cycle.

15. A process for separating air in a system which comprises the steps of:

i) compressing air in a compressor, sending a first part of the air to a combustor and a second part of the air to an air separation unit;

ii) separating at least the second part of the air in the air separation unit to form at least an oxygen enriched gas and a nitrogen enriched gas;

iii) sending a first stream of natural gas and at least part of the oxygen enriched gas to a natural gas conversion unit;

iv) compressing at least part of the nitrogen enriched gas and sending at least part of the compressed nitrogen enriched gas upstream of an expander; and v) feeding a second stream of natural gas to a natural gas liquefaction unit.

16. A process according to claim 15, wherein said expander operates a cycle compressor of a refrigeration cycle of the natural gas liquefaction unit.

17. A process according to claim 15, wherein said expander is coupled to the compressor, the natural gas conversion unit, the natural gas liquefaction unit and the air separation unit.

18. The process according to claim 15, wherein the second part of the air is compressed to a substantial pressure, P, in the compressor and is sent to the air separation unit to be separated at a pressure, P.

19. The process according to claim 15, wherein said expander is joined to the cycle compressor of a refrigeration cycle.

20. The process according to claim 15, wherein the natural gas conversion unit generates steam which is expanded in a steam turbine.

21. The process according to claim 15, wherein the air separation unit comprises at least two columns, at least one functions at a pressure of at least about 8 bar abs.

22. The process according to claim 15, wherein said process further comprises sending a fuel gas from the natural gas conversion unit to the combustor.

23. The process according to claim 15, wherein said process further comprises the steps of:

i) deriving steam from the natural gas conversion process;

ii) expanding the steam in a turbine; and iii) utilizing the energy produced to drive at least one compressor.

24. The process according to claim 23, wherein said compressor is at least one compressor selected from the group consisting of: a dedicated main air compressor of the air separation unit, a booster of the air separation unit, a compressor of the air separation unit compressing nitrogen enriched gas, a compressor of the air separation unit compressing oxygen enriched gas, and a compressor of a propane cycle of the natural gas liquefaction unit.

25. The process according to claim 23, wherein the electricity generated by the steam turbine provides power to a motor of at least one compressor selected from the group consisting of: a dedicated main, air compressor of the air separation unit, a booster of the air separation unit, a compressor of the air separation unit compressing nitrogen enriched gas, a compressor of the air separation unit compressing oxygen enriched gas, and a compressor of a propane cycle of the natural gas liquefaction unit.

26. The process according to claim 15, wherein the cycle compressor is a multi-component refrigeration fluid compressor.

27. The process according to claim 15, wherein the cycle compressor is a propane cycle compressor.

28. An apparatus for separating air which comprises:

a) an air separation unit;

b) a gas turbine having an air compressor;

c) a combustor;

d) an expander;

e) a natural gas conversion unit;

f) a natural gas liquefaction unit, g) conduits for sending air from the air compressor to the combustor and to the air separation unit;

h) a conduit for sending a nitrogen enriched gas from the air separation unit to a point upstream the expander;

i) a conduit for sending an oxygen enriched gas from the air separation unit to the natural gas conversion unit;

j) a conduit for sending a first stream of natural gas from a natural gas source to the natural gas conversion unit;

k) a conduit for sending a second stream of natural gas from the natural gas source to the natural gas liquefaction unit; and l) means for transferring work from the expander to the air compressor and to a compressor of a refrigeration cycle of the natural gas liquefaction unit.

29. The apparatus according to claim 28, wherein said expander is coupled to the air compressor.

30. The apparatus according to claim 28, wherein said apparatus further comprises a conduit for sending natural gas to a natural gas conversion unit and a conduit for sending an oxygen enriched gas from the air separation unit to the conversion unit.

31. The apparatus according to claim 28, wherein said expander is coupled to the compressor of the refrigeration cycle.

* * * * *